United States Patent [19]

Arzola

[11] 4,211,413

[45] Jul. 8, 1980

[54] FIELD GAME

[76] Inventor: Alberto H. Arzola, 40A Charles St., Jersey City, N.J. 07307

[21] Appl. No.: 933,717

[22] Filed: Aug. 15, 1978

[51] Int. Cl.[2] ..... A63B 71/02

[52] U.S. Cl. ..... 273/411

[58] Field of Search ..... 273/95 H; 272/3

[56] References Cited

U.S. PATENT DOCUMENTS

| | | | |
|---|---|---|---|
| 3,841,634 | 10/1974 | Mavrofrides | 273/95 H |
| 3,948,521 | 4/1976 | Warren | 273/95 H X |
| 4,014,545 | 3/1977 | Keim | 273/95 H |
| 4,047,717 | 9/1977 | DeAngelis | 273/95 H |

*Primary Examiner*—Charles E. Phillips

*Attorney, Agent, or Firm*—Robert D. Farkas

[57] ABSTRACT

A game comprising a ball field and playing apparatus, the ball field comprising a substantially flat surface having three playing zones, lines delineating a starting point for a pair of offensive team runners, first and second circles disposed in the first zone for defensive team members, base pads disposed in the first zone, lines delineating first and second safety lanes, respectively, the first and second bases being at the juncture of the first and second zones, a third circle disposed in the center of the surface, third and fourth base pads disposed on the juncture of the second and third zones, third and fourth bases disposed respectively at the inward ends of the third and fourth safety lanes and in the third zone, and a delineation of "home" and the playing apparatus comprising a flexible pole upstanding from the center of the third circle, a game ball, the pole being at its free end adapted to releasably retain the ball thereon, and barrier means disposed between the third and fourth bases and the delineation of "home".

10 Claims, 7 Drawing Figures

FIELD GAME

BACKGROUND OF THE INVENTION

THE FIELD OF THE INVENTION

This invention relates to games and is directed more particularly to a game including a ball field and playing apparatus.

SUMMARY OF THE INVENTION

An object of the present invention is to provide a new and unique game including a ball field and apparatus unique to sporting endeavors.

With the above and other objects in view, as will hereinafter appear, a feature of the present invention is the provision of a game comprising a ball field and playing apparatus, the ball field comprising a substantially flat surface having first and second end lines parallel to each other and spaced from each other by about 300 feet and connected to each other at each end thereof by first and second side lines, the surface including first, second, and third playing zones, each of the zones being of a length of about 100 feet, lines proximate the first end line delineating a starting point for a pair of offensive team runners, first and second circles disposed in the first zone delineating stations for defensive team members, first and second base pads disposed in the first zone, the circles being disposed generally between the starting point and the base pads, lines extending toward the second zone and outwardly from the base pads delineating first and second safety lanes, respectively, first and second bases disposed respectively at the outward ends of the safety lanes, the first and second bases being at the juncture of the first and second zones, first cross lines on the surface delineating the juncture, a third circle disposed in the center of the surface, second cross lines on the surface delineating a juncture of the second and third zones, third and fourth base pads disposed on the second and third zones' juncture, lines extending toward the second end line and inwardly from the third and fourth base pads delineating third and fourth safety lanes, third and fourth bases disposed respectively at the inward ends of the third and fourth safety lanes and in the third zone, and a delineation of "home" disposed beyond the second end line and aligned with the center of the second end line, and the playing apparatus comprising a flexible pole upstanding from the center of the third circle, a game ball, the pole being at its free end adapted to releasably retain the ball thereon, and barrier means disposed at the second end line and between the third and fourth bases and the delineation of "home".

The above and other features of the invention, including various novel details of construction and combinations of parts, will not be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

These objects as well as other objects of the present invention, will become more readily apparent after reading the following description of the accompanying drawings.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
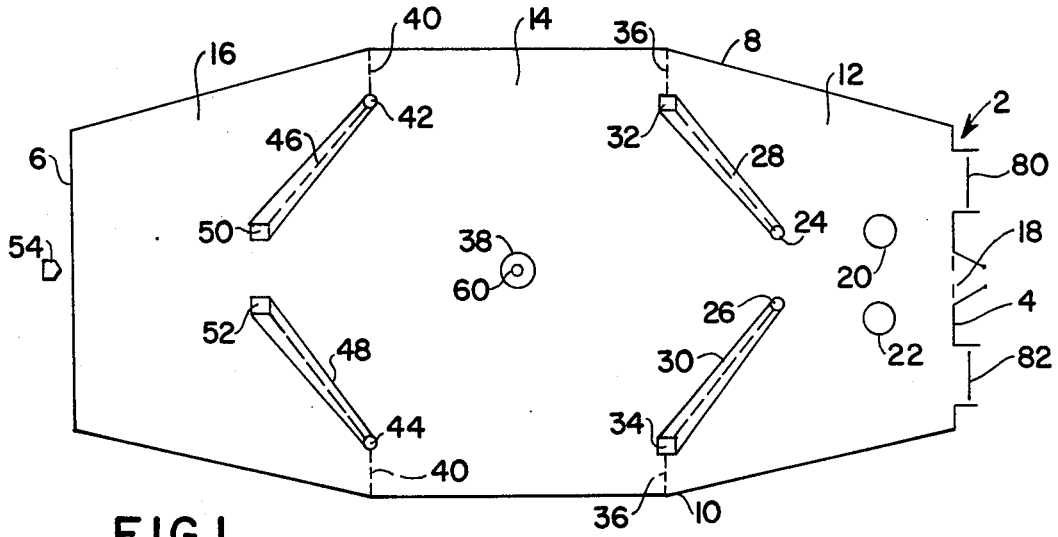
FIG. 1 is a plan view of one form of ball field forming a portion of an illustrative embodiment of the invention.
Figure 2:
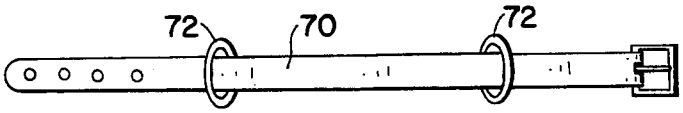
FIG. 2 is an elevational view of apparatus forming a portion of the illustrative game.
Figure 3:
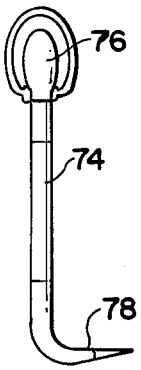
FIG. 3 is an elevational view of further apparatus used in the game.
Figure 4:
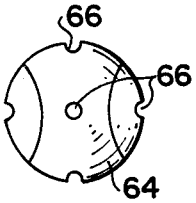
FIG. 4 is an elevational view of the ball used in the game.
Figure 5:
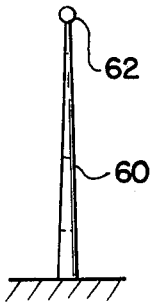
FIG. 5 is an elevational view of the flexible pole used in the game.
Figure 6:
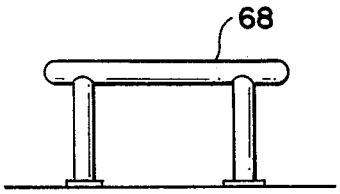
FIG. 6 is an elevational view of a barrier suitable for use in the game.

Referring to the drawings, it will be seen that the illustrative game includes a ball field 2 having a substantially flat surface and having first and second end lines 4,6 substantially parallel to each other and spaced from each other by about 300 feet. The end lines 4,6 are connected to each other at each end thereof by first and second side lines 8, 10. The ball field 2 is divided into first, second, and third playing zones 12, 14, 16, each being of a length of about 100 feet.

Lines proximate the first end line 4 delineate a starting point 18 for a pair of offensive team runners. First and second circles 20, 22 are disposed in the first zone 12 and delineate stations for defensive team members. First and second base pads 24, 26 are disposed in the first zone 12, the circles 20, 22 being disposed generally between the starting point 18 and the base pads 24, 26. Lines extending toward the second zone 14 and outwardly from the base pads 24, 26 delineate first and second safety lanes 28, 30, respectively. First and second bases 32, 34 are disposed respectively at the outward ends of the safety lanes 28, 30, the first and second bases 32, 34 being at the juncture of the first and second zones 12, 14. First cross lines 36 on the field surface delineate the first and second zones' juncture.

A third circle 38 is disposed in the center of the ball field 2, and also in the center of the second zone 14. Second cross lines 40 delineate a juncture of the second and third zones 14, 16.

Third and fourth base pads 42, 44 are disposed on the second and third zones' juncture. Lines extending toward the second end line 6 and inwardly from the third and fourth base pads 42, 44 delineate third and fourth safety lanes 46, 48. Third and fourth bases 50, 52 are disposed respectively at the inward ends of the third and fourth safety lanes 46, 48 and in the third zone 16.

A delineation of "home" 54 is disposed beyond the second end line 6 and is aligned with the center of the second end line.

Playing apparatus used on the field 2 includes a flexible pole 60 upstanding from the center of the third circle 38 having a ball 62 on its upper end. A game ball 64 is provided having holes 66 therein adapted to receive a portion of the flexible pole ball 62. Thus, the game ball 64 may rest upon the free end of the pole 60, the ball portion 62 of the pole partly disposed in a hole 66 of the game ball 64.

Disposed on the end line 6 is a barrier means 68 which comprises a jump which must be cleared by an offensive player prior to reaching "home" 54.

Each offensive runner has about his waist, a belt member 70 having loop means 72 attached thereto. The loop means 72 are so disposed as to provide a loop member at each side of the wearer. A stick member 74 is provided each defensive player and includes a handle portion 76 and a hook portion 78. The hook portion 78 is engageable with the loop means 72.

Referring again to FIG. 1, it will be seen that the side lines 8, 10 are parallel to each other in the area of the second zone 14. In zone 14, the side lines 8, 10 are preferably spaced apart from each other by about 150 feet. The side lines converge toward each other extending from the second zone to the end lines 4, 6 and at the end lines are separated from each other by about 100 feet. The safety lanes 28, 30, 46, 48 are each of a length of about 58 feet. The first and second bases 32, 34 and the third and fourth base pads 42, 44 are disposed inwardly of the nearest side lines by a distance of about 16 feet. The first and second base pads 24, 26 are about 16 feet from each other. The third and fourth bases 50, 52 are spaced apart by about 16 feet. "Home" is disposed eight feet from the barrier 68.

The ball field 2 may be provided with opposing team dugouts 80, 82 at the end line 4.

The game is to be played by two teams, each team having 10 players, six of which are active participants and four reserve players. Two umpires are arbiters and enforce the rules of the game.

Figure 7:
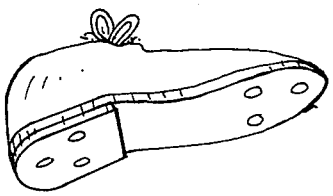
FIG. 7 is a perspective view of a shoe which may be used by players in the game.

In starting the game, two offensive players, wearing shoes as shown in FIG. 7, start from the starting point 18 upon a given signal by the chief arbiter. Their objective is to reach the flexible pole 60, take possession of the ball 64 on top of the pole 60, and with the ball 64 in hand jump over the barrier 68 and step on "home" 54. Such a play scores one point.

In the circles 20, 22 reside two players for the defensive team who wait until the starting signal of the arbiter before undertaking the task of getting the runners out by, using the sticks 74 with the hook means 78 thereon engageable with the loop means 72 worn on the belts 70 of the offensive runners to restrain or topple such runners. Once reaching the first or second base pads 24, 26 an offensive runner may proceed along the safety lanes 28, 30 unmolested. The safety lanes will carry the offensive players to the first and second bases 32, 34. The offensive players must then make a dash for the third circle 38 where they may once again find safety. To obtain the game ball 64, it is necessary that an offensive player deflect the pole 60 so as to dislodge the game ball 64 therefrom. It is then necessary that one of the offensive players catch the game ball 64 before it touches the ground, and proceed on toward home 54. The offensive player who obtains the game ball from the pole 60 must pass the ball through the air to his comrade who must then attempt to reach home.

In addition to the two defensive players in the circles 20, 22 the defensive team may position two players in the second zone 14 and two additional players in the third zone 16. One player must always remain in each zone. Accordingly, as the runners proceed from zone one to zone two, one of the defensive players in zone one may enter zone two. In changing zones, the defensive players must cross the cross lines 36, 40.

In order for an offensive runner to score a point the barrier 68 must be cleanly jumped and the player reach home 54 with the ball in hand and without the player or the ball first touching the ground.

Violations of rules on the part of defensive players will constitute errors and the accumulation of three errors will score a point for the offensive team. Three errors made by a single player will result in his temporary suspension from the game. When a defensive player falls to the ground, one fall will be recorded against his team and an accumulation of three falls will account for a point scored for the offensive team. Three falls by a single player results in his suspension from the game for a temporary period. When an offensive player falls to the ground it constitutes an out. When an out occurs, the two offensive runners return to the dugout and two other offensive runners are given the signal to start. After three outs, the two teams exchange positions.

The game preferably consists of nine innings, each inning divided into two parts, each part corresponding to an offensive effort of each team.

It is to be understood that the present invention is by no means limited to the particular embodiment herein disclosed and/or shown in the drawings, but also comprises any modifications or equivalents within the scope of the disclosure.

One of the advantages of the present invention is to provide a new and unique game including a ball field and apparatus unique to sporting endeavors.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A game comprising a ball field and playing apparatus, said ball field comprising a substantially flat surface having first and second end lines parallel to each other and spaced from each other by about three hundred feet and connected to each other at each end thereof by first and second side lines, said surface including first, second and third playing zones, each of said zones being of a length of about one hundred feet, lines proximate said first end line delineating a starting point for a pair of offensive team runners, first and second circles disposed in said first zone delineating stations for defensive team members, first and second base pads disposed in said first zone, said circles being disposed generally between said starting point and said base pads, lines extending toward said second zone and outwardly from said base pads delineating first and second safety lanes, respectively, first and second bases disposed respectively at the outward ends of said safety lanes, said first and second bases being at the juncture of said first and second zones, first cross lines on said surface delineating said juncture, a third circle disposed in the center of said surface, second cross lines on said surface delineating a juncture of said second and third zones, third and fourth base pads disposed on said second and third zones' juncture, lines extending toward said second end line and inwardly from said third and fourth base pads delineating third and fourth safety lanes, third and fourth bases disposed respectively at the inward ends of said third and fourth safety lanes and in said third zone, and a delineation of "home" disposed beyond said second end line and aligned with the center of said second end line, and said playing apparatus comprising a flexible pole upstanding from the center of said third circle, a game ball, said pole being at its free and adapted to releasably retain said ball thereon, and barrier means disposed at said second end line and between said third and fourth bases and said delineation of "home".

2. The invention in accordance with claim 1 including belt means for wear by first players of said game, loop means attached to said belt means, and hook means adapted to be carried by second players of said game, said hook means being engageable with said loop means.

3. The invention in accordance with claim 1 in which said game ball includes a hole therein and said pole at its free end having a ball means adapted to partially enter said game ball hole to releasably retain said game ball thereon.

4. The invention in accordance with claim 1 in which said barrier means comprises a jump structure adapted to be jumped over by a player.

5. The invention in accordance with claim 1 in which said first and second side lines are parallel to each other and spaced apart by about one hundred fifty feet at the center thereof.

6. The invention in accordance with claim 1 in which said first and second side lines are parallel to each other and spaced apart by about one hundred fifty feet in said second zone.

7. The invention in accordance with claim 6 in which said first and second side lines converge toward each other from said second zone to said first end line, said first end line being about one hundred feet in length, and said first and second side lines converge toward each other from said second zone to said second end line, said second end line being about one hundred feet in length.

8. The invention in accordance with claim 7 in which said safety lanes are each of a length of about fifty-eight feet.

9. The invention in accordance with claim 8 in which said first and second bases and said third and fourth base pads are disposed inwardly of the nearest side line by a distance of about sixteen feet, and said first and second base pads are about sixteen feet from each other, and said third and fourth bases are about sixteen feet from each other.

10. The invention in accordance with claim 9 in which said delineation of "home" is disposed eight feet from said barrier.

* * * * *